United States Patent [19]

Graves

[11] Patent Number: 4,638,957

[45] Date of Patent: Jan. 27, 1987

[54] BRAKE ENGAGEMENT MECHANISM FOR A WEB PRESS

[75] Inventor: Gene E. Graves, Centerville, Ohio

[73] Assignee: Harris Graphics Corporation, Melbourne, Fla.

[21] Appl. No.: 786,571

[22] Filed: Oct. 11, 1985

[51] Int. Cl.[4] ..... B65H 19/30; F16H 35/00

[52] U.S. Cl. ..... 242/58.6; 242/75.4; 74/384; 74/405

[58] Field of Search ..... 74/384, 405, 406; 242/58.6, 75.4

[56] References Cited

U.S. PATENT DOCUMENTS

| | | | |
|---|---|---|---|
| 2,810,299 | 10/1957 | Partridge | 74/384 X |
| 2,813,434 | 11/1957 | Stuebs | 74/405 |
| 3,176,928 | 4/1965 | Saunders | 242/58.6 |
| 3,321,147 | 5/1967 | Martin | 242/58.6 |
| 3,424,394 | 1/1969 | Moore | 242/58.6 |
| 4,154,144 | 5/1979 | Lyman | 74/405 X |
| 4,346,655 | 8/1982 | Suter et al. | 101/153 |

*Primary Examiner*—Stuart S. Levy
*Assistant Examiner*—David Werner
*Attorney, Agent, or Firm*—Biebel, French & Nauman

[57] ABSTRACT

A mechanism is provided for engaging a first gear with a second gear that is used to connect and disconnect a brake mechanism and a roll shaft within the unwind station of a web press. The first gear is mounted for rotation to a first shaft secured to a frame, while the second gear is carried for rotation on a member movable with respect to the frame. The member may be moved in a manner that will move the second gear along a path from a first disengaged position to a second engaged position. The mechanism includes a rigid support member pivotally mounted to the first shaft for pivotal movement about the shaft toward and away from the path along which the second gear is moved. A third gear is rotatably mounted on the support member and engages the first gear. A fourth gear is also rotatably mounted on the support member, the fourth gear being engaged with the third gear and adjacent to but not engaged with the first gear. The support member is biased into a normal position, wherein the fourth gear extends partially into the path of movement of the second gear.

19 Claims, 5 Drawing Figures

BRAKE ENGAGEMENT MECHANISM FOR A WEB PRESS

BACKGROUND OF THE INVENTION

The present invention relates generally to an unwind station of a web press, that is, to that portion within a web press where a roll of web material, typically paper, is held for unwinding as the web is fed into the press. More specifically, the invention relates to a mechanism for engaging and disengaging the shaft carrying the roll from a brake as the roll is loaded into or unloaded from the unwind station.

In a web press, web material is supplied to the press from a large roll positioned at one end of the press that is unwound as the material is fed through the various stations of the press. Such a roll can be quite heavy, typically weighing as much as 1800 (800 kg) pounds. Accordingly, the loading and positioning of a fresh roll into a press can be a formidable task. Most presses are therefore provided with a mechanism for lifting the roll into the unwind station of the press. Examples of such mechanisms are shown in U.S. Pat. No. 3,321,147 issued May 23, 1967 to Martin, and in U.S. Pat. No. 3,424,394 issued Jan. 28, 1969 to Moore.

In a typical unwind station, the roll is carried on a rotatably supported shaft. The shaft is not driven by the press, but is rotated as the web material is drawn into the press. Connected to one end of the shaft is an electromagnetic brake which is actuated and controlled electrically by the press control circuitry. The brake exerts a braking force on the shaft, and serves primarily to prevent overrunning of the roll as the press is stopped. The brake is also used at other times during the press operation, for example, to produce or maintain an appropriate amount of tension within the web.

Since the brake is coupled to the shaft which in turn supports the roll, the brake must be disconnected from the shaft as a used roll is lowered from the unwind station, and it must be reconnected once the new roll has been installed. Connection mechanisms for this purpose may typically include interlocking shafts with, for example, threaded collars for securing the connected shafts in place. Performing by hand the connection and disconnection operations during changing of a roll results in an increase in the non-productive time during which the press is shut down. Moreover, the potential is created for overlooking engagement or disengagement of the brake mechanism. In the case of a failure to disengage the brake prior to attempted lowering of the roll, the unsupported roll could be left attached to the brake, with the possibility of misalignment or other damage to the brake assembly. In the event connection of the brake following installation of a new roll is overlooked, operation of the press could result in the roll spinning in totally uncontrolled fashion.

What is needed, therefore, is a brake engagement and disengagement mechanism for the unwind station of a web press. Such a mechanism should require little or no direct action on the part of the press operator, thereby decreasing the amount of time necessary to change a roll, and reducing the possiblity of an overlooked connection or disconnection of the brake mechanism and the roll shaft. However, such a mechanism must be reliable to ensure that appropriate connection or disconnection is made.

SUMMARY OF THE INVENTION

In satisfying the aforementioned needs, the present invention provides a mechanism for engaging a first gear with a second gear that is used to connect and disconnect a brake mechanism and a roll shaft within the unwind station of a web press. The first gear is mounted for rotation to a first shaft secured to a frame, while the second gear is carried for rotation on a member movable with respect to the frame. The member has means associated therewith for moving the member in a manner that will move the second gear along a path from a first disengaged position to a second engaged position.

The mechanism includes a rigid support means pivotally mounted to the first shaft for pivotal movement about the shaft toward and away from the oath along which the second gear is moved. A third gear is rotatably mounted on the support means and engages the first gear. A fourth gear is also rotatably mounted on the support means, the fourth gear being engaged with the third gear and adjacent to but not engaged with the first gear. Means is provided for biasing the support means into a normal position, wherein the fourth gear extends partially into the path of movement of the second gear.

In connection with the mechanism, the movable member may include a rigid arm, with the arm being pivotally connected to the frame at one end of the arm. Two such arms are provided on opposite sides of the unwind station with a second shaft being supported for rotation at the ends of the arms. The arms may be raised and lowered for loading and unloading a roll. The second gear is connected to the second shaft, whereby said second gear is moved along an arcuate path as the arms are raised.

When the mechanism is used for engaging a roll shaft with a brake, the first shaft is connected to a brake which is in turn secured to the frame. The second shaft is used to support the roll for unwinding.

The rigid support means mounted to the first shaft may include a first support plate and a mounting block rotatably supported to the first or brake shaft, with third and fourth shafts being connected between the plate and block. The third gear is carried for rotation on the third shaft, with the fourth gear carried for rotation on the fourth shaft. The biasing means includes a spring connected between the block and the frame so as to exert biasing force to pivot the block, along with the connected shafts and gears, about the first shaft. A stop means is connected to the frame to contact the block to retain the support means in its normal position.

The first, second, third and fourth gears are all preferably of equal diameter and, of course, are all of identical tooth arrangements. Preferrably, the fourth gear extends not more than halfway into the path of movement of the second gear. The fourth gear preferably extends into the arcuate path from the concave side of the path, but may alternatively extend into the path from the convex side.

Accordingly, it is an object of the present invention to provide a mechanism for automatically engaging and disengaging a first gear and a second gear while providing proper alignment between the gears during engagement; to provide a mechanism whereby a shaft for supporting a roll of web material may be drivingly engaged with a brake mechanism automatically upon placement of the roll shaft into the unwind station of a press; to provide such a mechanism that will automatically disengage the roll shaft from the brake mechanism upon removal of the shaft from the unwind station; and to provide such a mechanism which is reliable and relatively simple in its operation and relatively inexpensive to construct.

Other objects and advantages of the present invention will be apparent from the following description, the accompanying drawings, and the appended claims.

DETAILED DESCRIPTION OF THE PREFERRED EMBODIMENT

Figure 1:
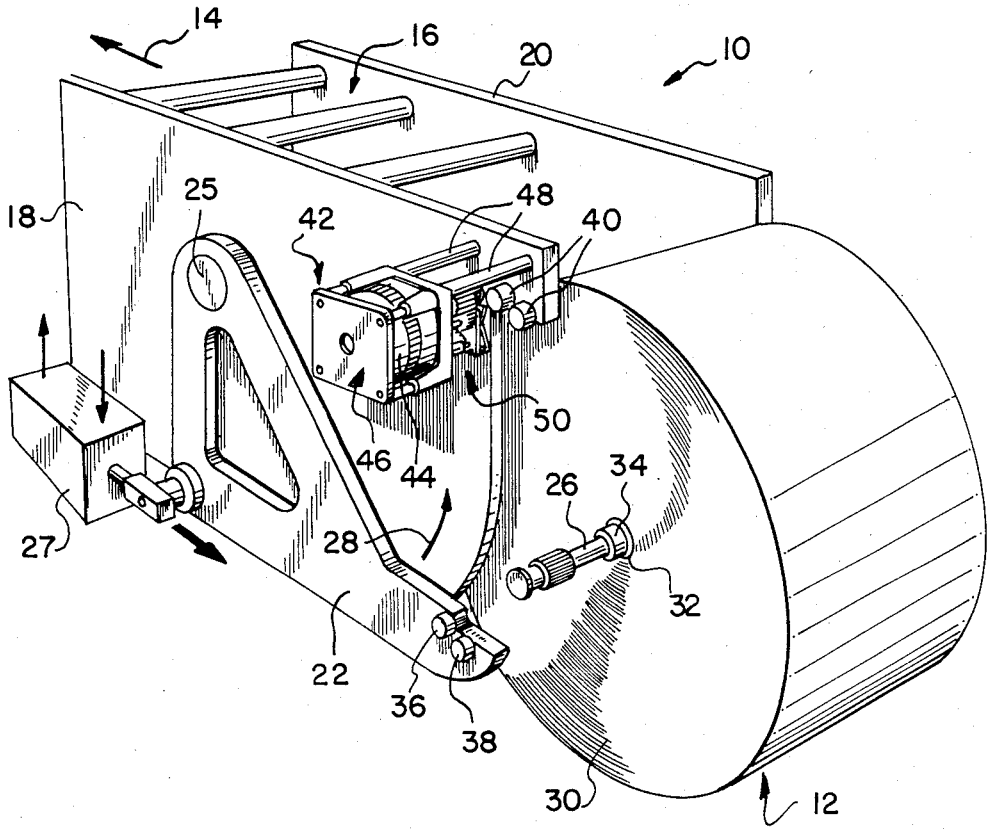
FIG. 1 is a perspective view of an unwind station for a web press, incorporating a brake engagement and disengagement mechanism in accordance with the present invention, showing a roll of web material positioned for installation into the unwind station.

Referring now generally to the drawings, and in particular to FIG. 1, an unwind station 10 for a web press is shown. A roll 12 of web material, typically paper, is supported within unwind station 10 for feeding into the web press, which is located with respect to unwind station 10 in the direction generally indicated by arrow 14. In addition to supporting roll 12, unwind station 10 includes a section, indicated generally at 16, wherein one or more dancer rolls are provided for ensuring uniform tension within the web as it enters the main portion of the press. Additionally, rolls are provided for directing the web to the dancer rolls regardless of the direction of unwinding of paper roll 12. This section of unwind station 10, as well as the web press itself, may be of conventional design.

Unwind station 10 includes a pair of frame walls 18 and 20. Each wall has a support arm 22 (only one shown) pivotally mounted thereto by shaft 25 which interconnects arms 22. Roll 12, which is supported by a shaft 26 as will be described below, is carried at the outer ends of arms 22. One arm 22 is connected to a conventional hydraulic cylinder 27 which is selectively actuated to raise arms 22 in the direction indicated generally by arrow 28, thereby raising roll 12 into an operating position. After roll 12 has been consumed through press operation, arms 22 may be lowered for subsequent loading of a new roll.

Roll 12 includes web material 30 wound about a central core 32, typically formed from cardboard or other rigid material. Prior to loading of roll 12 into unwind station 10, shaft 26 is inserted through core 32. An inflatable central portion 34 is provided on shaft 26, so that by connecting a compressed air supply to portion 34 at an appropriate valve opening (not shown), portion 34 can be expanded to secure shaft 26 and roll 12 in a fixed relationship. Portion 34 is provided with indicia, such as grooves, lines or other markings (not shown) to enable shaft 26 to be secured within core 32 in a predetermined relative position.

To load a roll 12 into unwind station 10, the roll 12 is rolled and maneuvered into the approximate position shown in FIG. 1. Shaft 26 is inserted and secured within roll 12, whereupon arms 22 are raised by cylinder 27 to lift roll 12 into an operating position. Roller bearings 36 and 38 are provided at the end of each arm 22 so that as arm 22 engages shaft 26 for lifting of the roll into place, shaft 26 is cradled between rollers 36 and 38, thereby enabling rotation of shaft 26 at the outer ends of arms 22. One or more roller bearings 40 are also provided upon framewalls 18 and 20 to ensure that the walls do not interfere with rotation of shaft 26.

In order to properly position printing, perforations, folds and the like laterally across the web as it moves through the press, it is necessary to properly position roll 12 laterally within unwind station 10. Accordingly, a lateral positioner and adjust mechanism (not shown) is mounted to framewall 20 for engagement with shaft 26. The mechanism laterally shifts shaft 26 on arms 22 to provide proper lateral position. One example of an appropriate mechanism is disclosed in copending commonly-assigned U.S. patent application Ser. No. 786,570 filed Oct. 11, 1985.

Once roll 12 has been loaded into unwind station 10, and as the press is operated, material is drawn from roll 12 by operation of other portions of the press, whereupon shaft 26 rotates upon bearings 36, 38 and 40. Since shaft 26 is not connected to the press drive train, a brake mechanism 42 must be connected to the end of shaft 26 adjacent framewall 18 to prevent overrunning of roll 12 as the press is stopped. The brake may be of conventional design, such as, for example, electromagnetic brake device 44. In the preferred embodiment, the brake device is a dynamic friction brake, commercially available from Eaton Corporation. The brake is secured within an appropriate brake frame 46 which is mounted by rods 48, cast integrally with frame 46, to frame wall 18.

Figure 2:
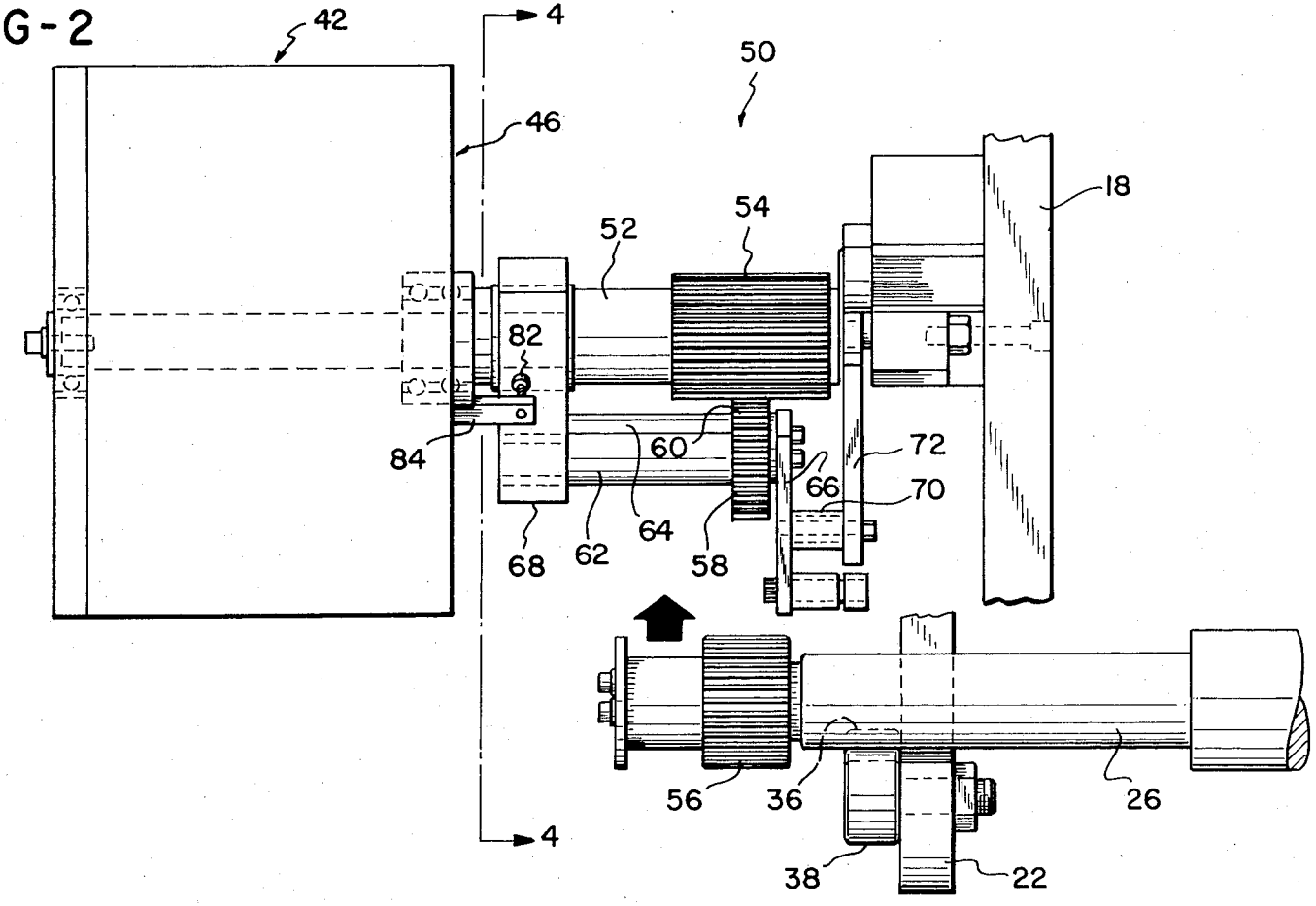
FIG. 2 is an end view of the engagement and disengagement mechanism, shown with the roll shaft being lifted into engagement with the mechanism.

In order to provide for automatic engagement of shaft 26 with brake mechanism 42 as roll 12 is lifted into place, an engagement mechanism is provided as generally indicated at 50. Mechanism 50 is shown in greater detail in FIGS. 2 and 3 to which reference will now be made. In both figures, shaft 26 supporting roll is shown in a partially raised position, as shaft 26 would appear just prior to engagement with mechanism 50. Both figures show various portions of the unwind station 10 eliminated for clarity, but is believed that in view of the following description, the structure, arrangement and operation of engagement mechanism 50 will be apparent to those skilled in the art.

A brake shaft 52 extends from brake mechanism 42 and is connected for rotation to frame wall 18, with a brake gear 54 carried upon shaft 52. A roll gear 56 is carried near the end of roll shaft 26, gear 56 being engageable with gear 54. Gears 54 and 56 provide the connection between brake mechanism 42 and roll 12, enabling the brake mechanism to operate upon the rotating roll. It is this connection that engagement mechanism 50 is intended to facilitate.

Gears 54 and 56 are of identical diameter and tooth arrangements, but gear 54 is of substantially greater length than gear 56. Since it is expected that shaft 26 will be laterally moved to provide for lateral adjustment of roll 12 within the unwind station, it is necessary that at least one of the gears 54 and 56 be of substantial length to ensure continued engagement of these gears despite lateral movement of shaft 26.

A pair of idler gears 58 and 60 are positioned beneath gear 54. Each of gears 58 and 60 is carried upon one of idler shafts 62 and 64, respectively, which are in turn connected between a mounting plate 66 and a mounting block 68. Gears 58 and 60 are of a diameter equal to that of gears 54 and 56, with an identical tooth arrangement, so that all gears 54, 56, 58 and 60 are mutually engageable with each other.

Mounting block 68, to which idler shafts 62 and 64 are connected, is carried on brake shaft 52, although shaft 52 rotates freely within mounting block 68. At the opposite ends of shafts 62 and 64 is mounting plate 66, which is in turn fixedly connected by pin 70 to a support arm 72. Arm 72 is in turn carried on shaft 52 which is freely rotatable within arm 72. Arm 72 and plate 66 together effectively function as a single plate.

Figure 3:
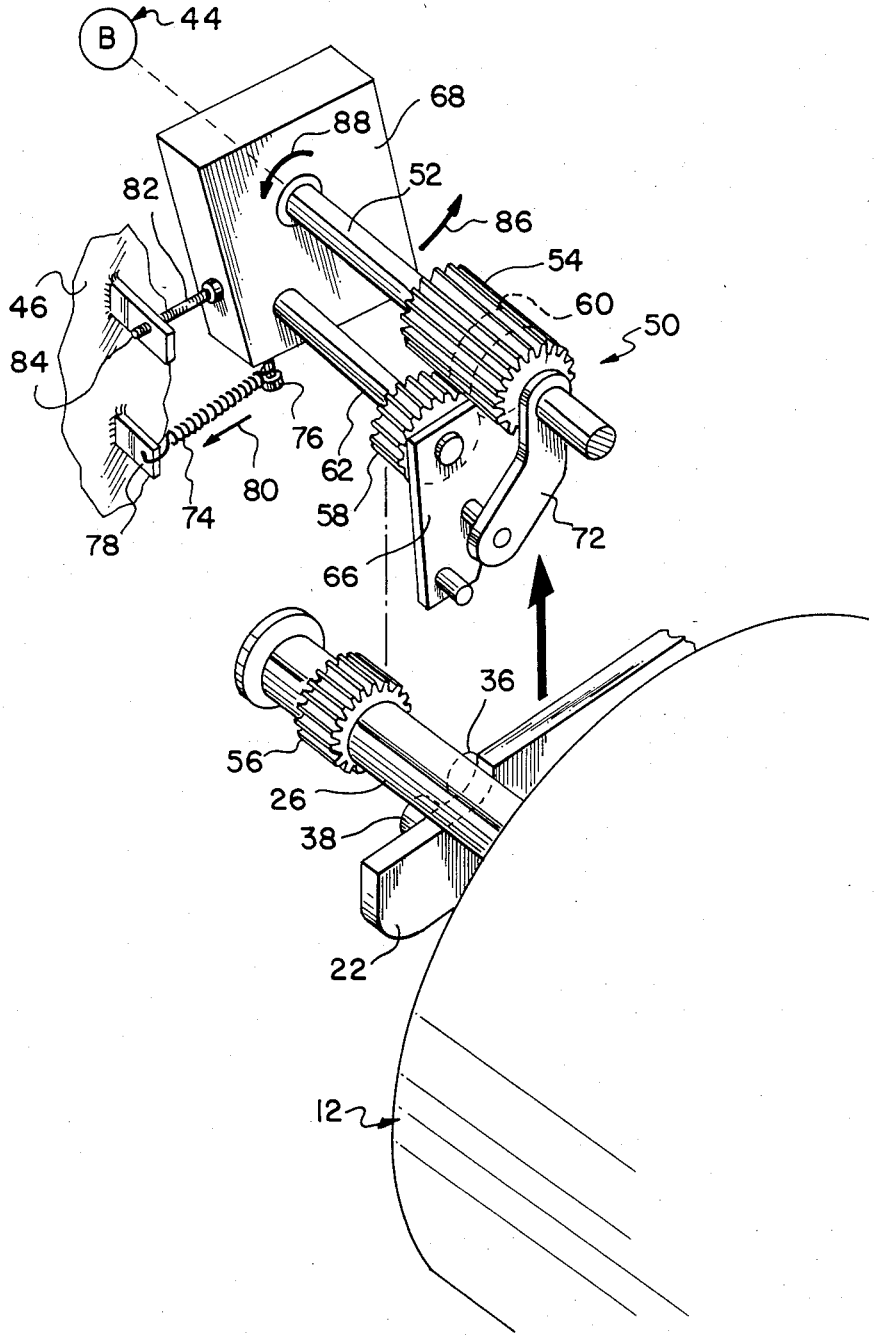
FIG. 3 is a perspective, partially schematic view of the mechanism illustrating movement of the roll shaft toward the mechanism.

It should be recognized from the foregoing that in view of the pivotal mounting of block 68 and arm 72 to shaft 52, block 68, arm 72, plate 66, gears 58 and 60 and shafts 62 and 64 may all be pivoted as an assembly about shaft 52. As shown in FIG. 3, a spring 74 is attached to pin 76, which is secured to block 68. The opposite end of spring 74 is secured to a block 78 which is schematically indicated as being connected to the mounting frame 46 of brake assembly 42. Thus, spring 74 exerts a biasing force upon block 68 in the direction indicated generally by arrow 80, biasing the entire mechanism 50 in a clockwise direction about shaft 52 as shown in FIG. 3. An adjustable stop screw 82 which is threadedly mounted into a support block 84 connected to brake frame 46 is provided to adjustably limit the extent to which mechanism 50 may be biased in a clockwise direction about shaft 52.

It can be seen from the foregoing, then, that mechanism 50 may be pivotally moved in the direction indicated generally by arrows 86 and 88. However, upon release of mechanism 50, the mechanism will move in the opposite direction under the influence of spring 74 until block 68 is moved into contact with stop 82.

Figure 4:
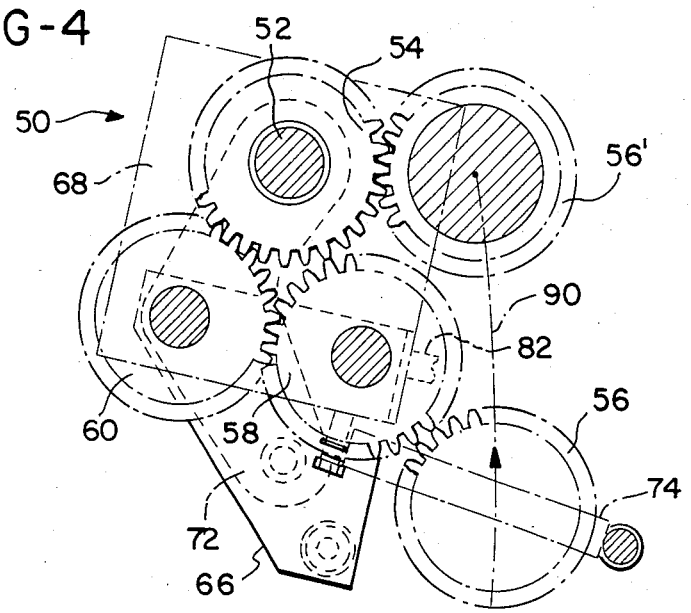
FIGS. 4 and 5 are side schematic views of the mechanism, illustrating its operation for engagement and disengagement of the brake mechanism and roll shaft.
Figure 5:
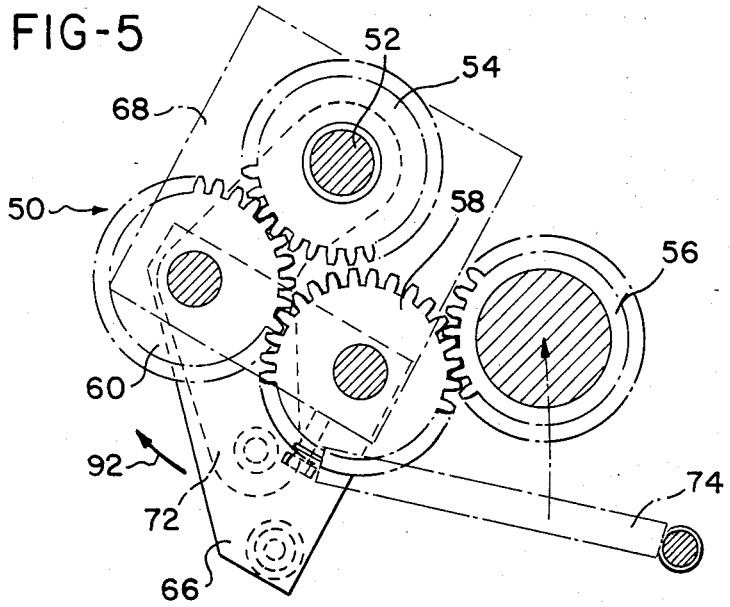

The operation of the engagement mechanism 50 for engaging the roll 12 with the brake mechanism 42 may be seen by reference to FIGS. 4 and 5, in which mechanism 50 is shown generally in schematic fashion. In FIG. 4, gear 56 is shown moving along a path indicated generally by line 90, movement of gear 56 being caused by movement of shaft 26 on arms 22 (see FIGS. 1 and 2).

It will be noted that at the final position for gear 56, indicated in FIG. 4 as gear 56', the gear is fully engaged with brake gear 54. However, it should also be recognized that, in view of the direct and rigid connections of gear 56 with roll 12 and of gear 54 with brake 44, it is not practical simply to move gear 56 into engagement with gear 54 without utilizing mechanism 50. In many instances, gear 56 could be moved into engagement with gear 54 without being in proper tooth-to-space alignment. In such a case, the force placed upon the misaligned teeth of gears 54 and 56 could easily cause breakage of the gear teeth. In the absence of gear mechanism 50, however, there would be no way to control tooth alignment between the gears, short of a substantial amount of operator involvement. However, not only would this be awkward for the operator, but also could only be performed safely by halting upward movement of arms 22 as roll 12 aproached its raised position.

It should be noted from FIG. 4 that idler gear 60 is mounted with respect to brake gear 54 so that gears 54 and 60 are properly engaged. Gear 58 is in turn engaged with gear 60. It should be further observed, however, that although gear 58 is positioned close to gear 54, the respective teeth of gears 54 and 58 do not engage. Thus, rotation of either gear 54 or gear 58 will result in rotation of the other of these gears in an identical direction.

As the arms of the unwind station are raised, shaft 26 carrying roll 12 is moved upward. Referring to FIG. 4, this upward movement causes gear 56 to move along the path generally indicated by arrow 90. Since gear 58 extends partially into the path of gear 56, gear 56 will contact gear 58 as it is carried upwardly along its path of movement.

It is possible that gear 56 will contact gear 58 such that there is essentially a complete tooth-to-space engagement between these gears. In such a case, further upward movement of gear 56 will cause rotation of gear 58 and will force gear 58 in a direction away from gear 56, causing pivotal movement of assembly about shaft 52 as shown by arrow 92 in FIG. 5. This pivotal movement extends spring 74 which, by urging block 68 back towards its original position, keeps gears 56 and 58 in engagement. Gear 56 then effectively moves around gear 58 as it continues its upward motion. Further, the positioning of gears 58, 60 and 54, in combination with their mutual engagement, causes gear 56 to approach gear 54 in proper alignment. Gear 56 then arrives at the position shown by gear 56' in FIG. 4, whereupon automatic connection of the roll shaft with the brake mechanism is complete.

While gear 56 may approach gear 58 in an aligned condition, it is also likely that gear 56 may approach gear 58 in a non-aligned relationship. In such a case, pivotal movement of mechanism 50 may be sufficient to cause the teeth of gears 58 and 56 to become sufficiently aligned for gear 58 to slide into engagement with gear 56. This will cause a slight movement of mechanism 50 in the reverse pivotal direction, whereafter normal movement of the gears into engagement will continue.

As a third possibility, gears 56 and 58 could come into contact in a direct tooth-to-tooth misalignment such that the gears never engage throughout the entire movement of gear 56 about gear 58. In such a case, however, it will be seen that mechanism 50 will be pivotally displaced by an additional amount equal to the depth of the gear teeth, which will have the effect of a slight additional rotation of gear 54 with respect to gear 56. This additional rotation will be enough to cause gear 54 to be in alignnment with gear 56 as gear 56 completes its movement past gear 58.

Once gear 56 has been engaged with gear 54, normal operations of the web press may be begun. Rotation of roll shaft 26 will cause rotation not only of gear 54 and brake shaft 52, but also of idler gears 58 and 60 and their associated shafts. While this will place an additional load upon the press drive system, any such additional load will be negligible in terms of the overall system.

Referring back to FIG. 4, it can be seen that gear 58 must extend into the path defined by arrow 90 sufficiently to make secure contact with gear 56 as it is moved past. However, the farther gear 58 extends into the path, the greater the force which must be exerted upon gear 58 by gear 56 to move it and the remainder of the mechanism 50 from the path. Greater force requirements not only affect the design of the lifting mechanism for arms 22, but also causes greater stress to be placed upon gears 58 and 56. Further, gear 58 cannot extend so far into the path that the gear is centered on the path, since no pivotal movement would be possible.

In view of this, it is preferred that this gear extend into the path no more than halfway, i.e., with the gear teeth, as seen in FIG. 4, not extending beyond arrow 90. This will result in sufficient contact between the gears, but will avoid undue stress on the parts of the mechanism.

It can also be seen that mechanism 50, including gear 54 and brake shaft 52, is disposed on the concave side of the arcuate path defined by gear 56 during the pivotal lifting movement of arms 22. It is not required that this be so, and the mechanism may be located on the convex side of the movement path. As a practical matter, however, positioning on the concave path side may be preferred, since a longer frame could be required to provide sufficient mounting space for the brake 42 and engagement mechanism 50 in the case of locaton on the convex path side.

When the roll 12 has been exhausted and it is necessary to remove shaft 26 from the unwind station, the arms supporting shaft 26 are lowered. Gear 56 then moves out of engagement with gear 54 in a manner exactly opposite to that depicted in FIGS. 4 and 5. However, since gear 56 is in engagement with gear 54, gear 56 will aways move into engagement with gear 58 for movement therepast, after which shaft 26 may be lowered to the floor.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A mechanism for engaging a first gear with a second gear, said first gear being mounted for rotation with a first shaft rotatably secured to a frame, said second gear being carried for rotation on a member movable with respect to the frame, said member having means associated therewith for moving said member so as to move said second gear along a path from a first disengaged position to a second engaged position, said mechanism comprising:

a rigid support means pivotally mounted to said first shaft for pivotal movement about said first shaft toward and away from said path;

a third gear rotatably mounted on said support means and engaged with said first gear;

a fourth gear rotatably mounted on said support means, engaged with said third gear and adjacent to but not engaged with said first gear; and means for biasing said support means into a normal position wherein said fourth gear extends partially into said path.

2. The mechanism as defined in claim 1, wherein said movable member includes a rigid arm having first and second ends, said arm being pivotally connected to said frame at said first end, and further comprising a second shaft supported for rotation at said second end of said arm, said second gear being connected to said second shaft, whereby said second gear is moved along an arcuate path.

3. The mechanism as defined in claim 1, wherein said support means includes a support plate, and further comprising third and fourth shafts each having first and second ends, said third shaft being connected at its first end to said plate, said third gear being carried for rotation on said third shaft, and said fourth shaft being connected at its first end to said first plate, said fourth gear being carried for rotation on said fourth shaft.

4. The mechanism as defined in claim 3, wherein said support means further includes a mounting block pivotally mounted to said first shaft, said third and fourth shafts being connected at the respective second ends thereof to said mounting block.

5. The mechanism as defined in claim 4, wherein said biasing means includes a spring connected between said mounting block and said frame so as to exert biasing force to pivot said block about said first shaft.

6. The mechanism as defined in claim 5, further comprising stop means connected to said frame for contact with said mounting block to retain said support means in said normal position.

7. The mechanism as defined in claim 1, wherein said first, second, third and fourth gears are of equal diameter.

8. The mechanism as defined in claim 1, wherein said fourth gear extends not more than halfway into said path.

9. The mechanism as defined in claim 2, wherein said fourth gear extends into said arcuate path from the concave side thereof.

10. The mechanism as defined in claim 2, wherein said fourth gear extends into said arcuate path from the convex side thereof.

11. A mechanism for automatically engaging the roll shaft of an unwind station of a web press with a brake device, said unwind station having a frame, first and second arms pivotally connected thereto, means for raising and lowering said arms, and means disposed on said arms for rotatably supporting said roll shaft, said brake device being secured to said frame and having a brake shaft extending therefrom for driving said brake device, the mechanism comprising:

a first gear connected to said brake shaft;

a second gear connected to said roll shaft such that said second gear is movable, upon raising of said arms, along an arcuate path from a first disengaged position to a second position engaged with said first gear;

a rigid support means pivotally mounted to said brake shaft for pivotal movement about said brake shaft toward and away from said path;

a third gear rotatably mounted on said support means and engaged with said first gear;

a fourth gear rotatably mounted on said support means, engaged with said third gear and adjacent to but not engaged with said first gear; and means for biasing said support means into a normal position wherein said fourth gear extends partially into said path.

12. The mechanism as defined in claim 11, wherein said support means includes a support plate, and further comprising third and fourth shafts each having first and second ends, said third shaft being connected at its first end to said plate, said third gear being carried for rotation on said third shaft, and said fourth shaft being connected at its first end to said plate, said fourth gear being carried for rotation on said fourth shaft.

13. The mechanism as defined in claim 12, wherein said support means further includes a mounting block pivotally mounted to said brake shaft, said third and fourth shafts being connected at the respective second ends thereof to said mounting block.

14. The mechanism as defined in claim 13, wherein said biasing means includes a spring connected between said mounting block and said frame so as to exert biasing force to pivot said block about said brake shaft.

15. The mechanism as defined in claim 14, further comprising stop means connected to said frame for contact with said mounting block to retain said support means in said normal position.

16. The mechanism as defined in claim 11, wherein said first, second, third and fourth gears are of equal diameter.

17. The mechanism as defined in claim 11, wherein said fourth gear extends not more than halfway into said path.

18. The mechanism as defined in claim 11, wherein said fourth gear extends into said arcuate path from the concave side thereof.

19. The mechanism as defined in claim 11, wherein said fourth gear extends into said arcuate path from the convex side thereof.

* * * * *